United States Patent [19]

Ivie

[11] 3,955,461

[45] May 11, 1976

[54] MUSICAL INSTRUMENT STABILIZER

[76] Inventor: Clarence L. Ivie, P.O. Box 226, Liberty, Tex. 77575

[22] Filed: Mar. 17, 1975

[21] Appl. No.: 559,143

[52] U.S. Cl. ..... 84/327
[51] Int. Cl.[2] ..... G10G 5/00
[58] Field of Search ..... 84/267, 280, 327, 411, 84/421

[56] References Cited

UNITED STATES PATENTS

| | | | |
|---|---|---|---|
| 932,844 | 8/1909 | Beisheim | 84/280 |
| 1,133,615 | 3/1915 | Clark | 84/327 |
| 1,323,468 | 12/1919 | Hammack | 84/280 |
| 1,945,162 | 1/1934 | Rasmussen | 84/327 |
| 3,021,744 | 2/1962 | Kester | 84/421 |

OTHER PUBLICATIONS

Rogers Drums Catalog 64 R, Rogers Drums, Inc., Cleveland, Ohio, 1964, p. 67.

*Primary Examiner*—Lawrence R. Franklin
*Attorney, Agent, or Firm*—Torres & Berryhill

[57] ABSTRACT

Apparatus for stabilizing a stringed musical instrument, while held by a musician, of the type having a body and fretted neck. The apparatus may comprise: a support member for resting against the trunk of the musician's body; a rod member attached at one end to the support member and projecting generally away from the musician's body trunk; and a mounting member attached to the back of the instrument body and engageable by the other end of the rod member to generally support the instrument in an oblique plane for better viewing of the fretted neck.

10 Claims, 3 Drawing Figures

MUSICAL INSTRUMENT STABILIZER

BACKGROUND OF THE INVENTION

1. Field of the Invention

The present invention pertains to stabilizing or support apparatus for musical instruments. More specifically, the present invention pertains to stabilizing or support apparatus for musical instruments of the type having a body and fretted neck, e.g. guitars, banjos, mandolins and the like.

2. Description of the Prior Art

Musical instruments of the type having a body and fretted neck, e.g. guitars, banjos, mandolins, etc., may be played while sitting or standing. If the musician is sitting, the instrument can usually be rested on the leg. Even when sitting, it is sometimes desirable to provide some means of supporting the instrument other than directly against the leg. U.S. Pat. Nos. 752,664; 1,285,802; and 1,802,236 illustrate apparatus designed to aid in supporting an instrument when the musician is in a sitting position.

However, it is not always possible for the musician to be in a sitting position. Furthermore, even if it is possible, many musicians prefer to play from a standing position. This is particularly true of musicians who sing while they accompany themselves on an instrument. Of course, various types of support straps have been devised which are usually are attached at opposite ends to the instrument body and neck for placing around the neck or shoulder of the musician. Other apparatus has been developed for supplementing or taking the place of such straps. Examples may be seen in U.S. Pat. Nos. 3,037,416 and 3,371,570. However, the primary purpose of such apparatus is merely to support the instrument.

One problem associated with supporting an instrument, when the musician is standing, is positioning of the instrument for a better view of the fretted neck. Nearly all musicians prefer to view the neck of the instrument as they are playing to be sure that the proper notes or chords are being fingered. Straps and other above-mentioned support apparatus do not serve this purpose. In fact, most of them tend to position the instrument in a substantially vertical plane so that the musician still must exert effort, generally with the hand gripping the instrument neck, so as to position the instrument in an oblique plane for better viewing of the frets.

A few devices, such as those shown in U.S. Pat. Nos. 1,342,202 and 2,547,924, have been devised for supporting an instrument in such an oblique plane for better viewing of the frets, in addition to the pure support function. However, although a number of these stand devices are collapsible, they are relatively expensive, cumbersome and inflexible. This probably explains the reason why they have not come into wide use or acceptance.

The fact remains that, so far as is known by the applicant, there is not a universally acceptable support device for stringed musical instruments of the type having a body and fretted neck suitable both for support and positioning of the instrument for better viewing of the frets while the musician is standing.

SUMMARY OF THE INVENTION

The stabilizer or support apparatus of the present invention fulfills the need for a universally acceptable supporting and positioning means for a musical instrument of the type having a body and fretted neck. In addition to supplementing the support function of a conventional strap, it provides a means of positioning the instrument in an oblique plane so that the frets can be easily viewed without having to exert the force necessary to cant the instrument as in the past.

The stabilizer or support apparatus of the present invention may comprise: a support member for resting against the trunk of the musician's body; a rod member attached at one end to the support member and projecting generally away from the musician's body trunk; and a mounting member attached to the back of the body of the instrument and engageable by the other end of the rod member to generally support the instrument in an oblique plane for better viewing of the fretted neck. Engagement of the rod member with the mounting member may be effected by a unique swivel joint, permitting flexibility in positioning. Such a joint also permits easy disassembly and storage of the device.

Furthermore, the rod member may be extendable and retractable for adjustment to the particular positioning desired by the musician. Many other objects and advantages of the invention will be apparent from a reading of the following specification in conjunction with the accompanying drawing.

DESCRIPTION OF A PREFERRED EMBODIMENT

Figure 1:
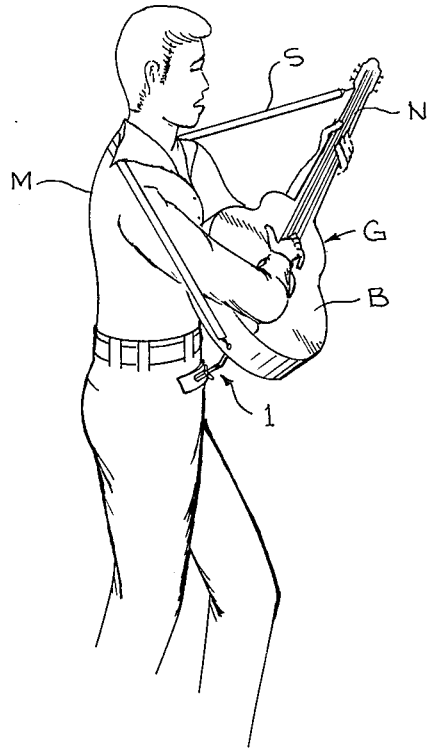
FIG. 1 is a pictorial illustration of a musician utilizing stabilizer apparatus of the present invention with a guitar.

Referring first to FIG. 1, there is shown a standing musician M playing a stringed musical instrument, i.e. a guitar G, having a body B and a fretted neck N. The instrument is at least partially supported by a conventional strap S attached at one end to the neck N and at the opposite end to the body B of the guitar G.

Also supporting the guitar G against the trunk of the musician's body M is a stabilizer or support device 1, according to a preferred embodiment of the invention. The stabilizer 1 supports the guitar G in an oblique plane for easy viewing of the fretted neck N by the musician M.

Figure 2:
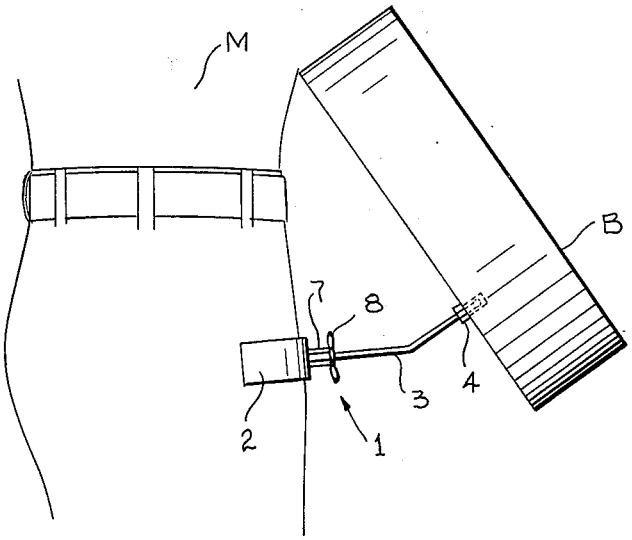
FIG. 2 is a side elevation view of a portion of a musician's body and guitar, such as in FIG. 1, further illustrating the relative positioning of the stabilizer apparatus of the present invention.
Figure 3:
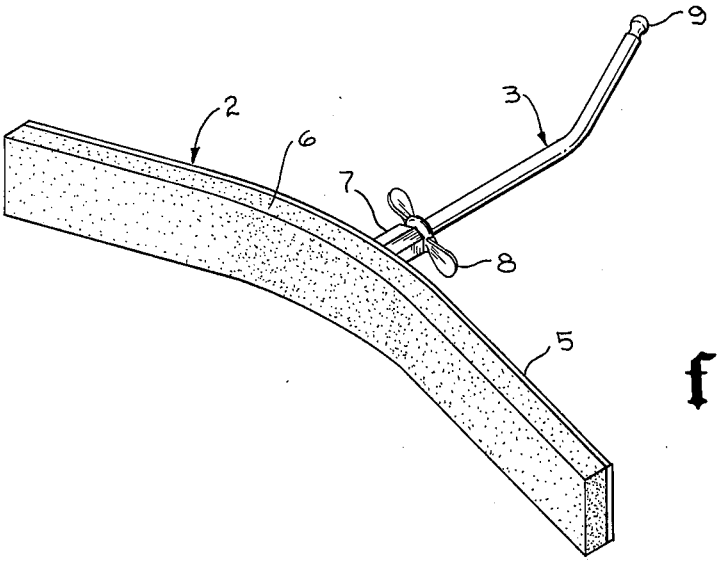
FIG. 3 is a perspective view of a substantial portion of the stabilizer apparatus of the present invention, according to a preferred embodiment thereof.

Also referring to FIG. 2 and FIG. 3, the stabilizer apparatus 1 of the present invention comprises a support member 2, rod member 3 and mounting member 4. The rod member 3 is attached at one end to the support member and projects generally away from the musician's body trunk. The mounting member 4 is attached to the back of the guitar body B and is engageable by the other end of the rod member to generally support the instrument in an oblique plane, as best seen in FIG. 2, for better viewing of the fretted neck N (see FIG. 1).

The support member 2 may comprise a plate or strap 5 arcuately formed to substantially conform to the contours of the trunk of the musician's body against which the support member 2 rests. The arcuate plate may be of metal or any other suitable rigid material. To render the support member 2 more comfortable against the body, a pad 6 of any suitable resilient material, i.e. rubber, fabric or the like, may be provided. A nut or female coupling member 7 may be attached to arcuate plate 5 by welding or the like.

The rod member 3 may be threaded at one end for connection with the nut 7 of the support member 2. A wing nut or any other suitable type of lock nut 8 may be provided for locking the rod member 3 to the support member 2. By loosening the lock nut, the rod member may be extended or retracted, relative to the musician's trunk, by simply rotating the rod member 3, within limits, relative to the mounting nut 7.

It will be noted that the rod member 3 is bent so that its axis at the end adjacent guitar G is further away from the horizontal than its axis at the end attached to the support member 2. This construction is preferable for supporting the guitar in an oblique plane. However, the rod member 3 may be gradually bent in a curve or constructed in any other way to accomplish the same result.

It will also be noted, in the preferred embodiment, that the other end of the rod member 3 is provided with a ball 9 which may cooperate with mounting member 4 to form a swivel or ball and socket type joint. The mounting member 4 is preferably a socket mounted on the body B of the instrument and engageable by the ball 9 of rod member 3. This permits limited swiveling of the instrument about the ball 9. Although the mounting member 4 is shown as a socket member mounted in a hole therefor in the body B, it is to be understood that such a mounting could be adapted for connection to the instrument without having to drill a hole in it.

Thus, it can be seen that the stabilizer apparatus of the present invention, in addition to supplementing support of a conventional strap, allows a stringed musical instrument to be supported in an oblique plane for better viewing of the fretted neck by the musician. This is accomplished with an economically attractive device, easy to install, adjust and remove. It could very easily be provided in kit form for attachment to existing musical instruments or as a part of new instruments. It solves the positioning problems of instruments played in a standing position in a simple and efficient way. Although it was designed primarily for standing, it could also be used while sitting.

Although a single preferred embodiment of the invention has been described herein, many variations can be made by those skilled in the art without departing from the spirit of the invention. It is therefore intended that the scope of the invention be limited only by the claims which follow.

I claim:

1. Apparatus for stabilizing a stringed musical instrument, while held by a musician, of the type having a body and fretted neck, said apparatus comprising:

a support member for resting against the trunk of said musician's body;

a rod member attached at one end to said support member and projecting generally away from said musician's body trunk; and a mounting member attached to the back of the body of said instrument and engageable by the other end of said rod member to generally support said instrument in an oblique plane for better viewing of said fretted neck, said mounting member being disengageable by said other end of said rod member to facilitate storage of said instrument.

2. Apparatus as set forth in claim 1 in which said mounting member and said other end of said rod member make up a swivel joint about which said instrument may swivel within predetermined limits.

3. Apparatus as set forth in claim 2 in which said swivel joint comprises a ball member at said other end of said rod member engageable with a socket on said mounting member.

4. Apparatus as set forth in claim 2 in which said rod member is bent so that its axis near said other end is further away from the horizontal than its axis at said one end.

5. Apparatus as set forth in claim 1 in which said one end of said rod member and said support member are connected by adjustable connection means to permit limited extension and retraction of said rod member relative to said musician's trunk.

6. Apparatus as set forth in claim 5 including lock means for locking said adjustable connection means to prevent further extension and retraction of said rod member.

7. Apparatus as set forth in claim 5 in which said adjustable connection means comprises cooperable male and female threads on said support member and one end of said rod member.

8. Apparatus for stabilizing a stringed musical instrument, while held by a musician, of the type having a body and fretted neck, said apparatus comprising:

an arcuate support member for resting against the trunk of said musician's body;

a rod member attached at one end to said support member and projecting generally away from said musician's body trunk;

a ball member at the other end of said rod member; and a socket member mounted on the body of said instrument and engageable by said ball member to generally support said instrument in an oblique plane for better viewing of said fretted neck and disengageable by said ball member to leave said instrument free of said support, rod and ball members for storage.

9. Apparatus as set forth in claim 8 in which said rod member is adapted for limited extension and retraction relative to said musician's body trunk.

10. Apparatus as set forth in claim 8 in which the axis of said ball member is further away from the horizontal than the axis of said rod member at said one end.

* * * * *